US011423849B2

(12) United States Patent
Huang et al.

(10) Patent No.: US 11,423,849 B2
(45) Date of Patent: Aug. 23, 2022

(54) DISPLAY PANEL HAVING A VOLTAGE COMPENSATION CIRCUIT

(71) Applicant: YUNGU (GU'AN) TECHNOLOGY CO., LTD., Hebei (CN)

(72) Inventors: Zhen Huang, Langfang (CN); Dake Yang, Langfang (CN); Dong Ren, Langfang (CN); Gang Liu, Langfang (CN); Xiang Zhao, Langfang (CN); Hui Zhu, Langfang (CN)

(73) Assignee: YUNGU (GU'AN) TECHNOLOGY CO., LTD., Langfang (CN)

( * ) Notice: Subject to any disclaimer, the term of this patent is extended or adjusted under 35 U.S.C. 154(b) by 0 days.

(21) Appl. No.: 17/338,930

(22) Filed: Jun. 4, 2021

(65) Prior Publication Data

US 2021/0295785 A1 Sep. 23, 2021

Related U.S. Application Data

(63) Continuation of application No. PCT/CN2019/125290, filed on Dec. 13, 2019.

(30) Foreign Application Priority Data

May 15, 2019 (CN) ..... 201910403530.3

(51) Int. Cl.
*G09G 3/3291* (2016.01)
*G09G 3/3233* (2016.01)

(52) U.S. Cl.
CPC ..... *G09G 3/3291* (2013.01); *G09G 3/3233* (2013.01); *G09G 2300/043* (2013.01);
(Continued)

(58) Field of Classification Search
CPC ..... G09G 3/3291
(Continued)

(56) References Cited

U.S. PATENT DOCUMENTS 10,636,357 B1 * 4/2020 Brownlow ..... G09G 3/32
2010/0225634 A1 9/2010 Levey et al.
(Continued)

FOREIGN PATENT DOCUMENTS

CN 1637817 A 7/2005
CN 101136169 A 3/2008
(Continued)

OTHER PUBLICATIONS

International Search Report dated Mar. 13, 2020 in corresponding International application No. PCT/CN2019/125290; 4 pages.
(Continued)

*Primary Examiner* — Long D Pham
(74) *Attorney, Agent, or Firm* — Maier & Maier, PLLC

(57) ABSTRACT

A display panel includes a data line, a pixel driving circuit, a light-emitting device and a voltage compensation circuit. The voltage compensation circuit includes a sampling and conditioning unit configured to obtain a driving current output by the pixel driving circuit and to output a control signal according to the driving current; a first switch unit including a control terminal, an input terminal and an output terminal, the control terminal of the first switch unit being connected to an output terminal of the sampling and conditioning unit, and the input terminal of the first switch unit being connected to the output terminal of the pixel driving circuit; a compensation unit including an input terminal and an output terminal, the input terminal of the compensation unit being connected to the output terminal of the first switch unit, and the output terminal of the compensation unit being connected to the data line.

13 Claims, 8 Drawing Sheets

(52) U.S. Cl.
CPC ..... *G09G 2300/0809* (2013.01); *G09G 2310/0294* (2013.01); *G09G 2320/0257* (2013.01)

(58) Field of Classification Search
USPC ..... 345/76
See application file for complete search history.

(56) References Cited

U.S. PATENT DOCUMENTS

| | | | | |
|---|---|---|---|---|
| 2015/0103066 | A1 | 4/2015 | Tsuchi | |
| 2017/0169796 | A1* | 6/2017 | Tai | G09G 3/3233 |
| 2019/0094261 | A1 | 3/2019 | Van Der Merwe | |
| 2019/0139492 | A1* | 5/2019 | Chen | G09G 3/3266 |

FOREIGN PATENT DOCUMENTS

| | | | |
|---|---|---|---|
| CN | 101226413 | A | 7/2008 |
| CN | 104064148 | A | 9/2014 |
| CN | 104091568 | A | 10/2014 |
| CN | 104882094 | A | 9/2015 |
| CN | 105304023 | A | 2/2016 |
| CN | 104036722 | A | 3/2016 |
| CN | 106057130 | A | 10/2016 |
| CN | 107146578 | A | 9/2017 |
| CN | 108269537 | A | 7/2018 |
| CN | 108665836 | A | 10/2018 |
| CN | 109961742 | A | 7/2019 |

OTHER PUBLICATIONS

Chinese Office Action dated Apr. 1, 2020 in corresponding application No. 201910403530.3; 15 pages.

Chinese First Search dated Mar. 23, 2020 in corresponding application No. 201910403530.3; 2 pages.

* cited by examiner

DISPLAY PANEL HAVING A VOLTAGE COMPENSATION CIRCUIT

CROSS REFERENCE TO RELATED APPLICATIONS

The present application is a continuation of International Patent Application No. PCT/CN2019/125290, filed on Dec. 13, 2019, which is based on and claims priority to Chinese Patent Application No. 201910403530.3 filed with the CNIPA on May 15, 2019, disclosures of which are incorporated herein by reference in their entireties.

TECHNICAL FIELD

The present application relates to display technologies and, particularly, to a display panel and a display apparatus.

BACKGROUND

Display panels are widely used in modern electronic equipment. Organic light-emitting diode (OLED) display panels have advantages such as self-luminescence and wide viewing angle and are considered the next generation of display technologies.

However, during the display process of the OLED display panels, an image-sticking phenomenon may occur, impacting the display quality of the display panel.

SUMMARY

The present application provided by a display panel and a display apparatus so as to achieve the compensation for the image-sticking phenomenon of a display panel and improve the display effect.

An embodiment of the present application provides a display panel. The display panel includes a data line, a pixel driving circuit, a light-emitting device and a voltage compensation circuit.

The pixel driving circuit includes a data signal input terminal and an output terminal, where the data signal input terminal of the pixel driving circuit is electrically connected to the data line, and the output terminal of the pixel driving circuit is electrically connected to the light-emitting device.

The voltage compensation circuit includes a sampling and conditioning unit, a first switch unit and a compensation unit.

The sampling and conditioning unit is configured to obtain a driving current output by the pixel driving circuit and to output a control signal from an output terminal of the sampling and conditioning unit according to the driving current.

The first switch unit includes a control terminal, an input terminal and an output terminal; where the control terminal of the first switch unit is electrically connected to the output terminal of the sampling and conditioning unit, and the input terminal of the first switch unit is electrically connected to the output terminal of the pixel driving circuit; and the first switch unit is configured to control turn-on or turn-off between the input terminal of the first switch unit and output terminal of the first switch unit according to a signal of the control terminal of the first switch unit.

The compensation unit includes an input terminal and an output terminal, where the input terminal of the compensation unit is electrically connected to the output terminal of the first switch unit, the output terminal of the compensation unit is electrically connected to the data line, and the compensation unit is configured to output a compensation voltage to the data line under an action of a signal of the input terminal of the compensation unit.

An embodiment of the present application further provides a display apparatus. The display apparatus includes the display panel provided by any embodiment of the present application.

DETAILED DESCRIPTION

Figure 1:
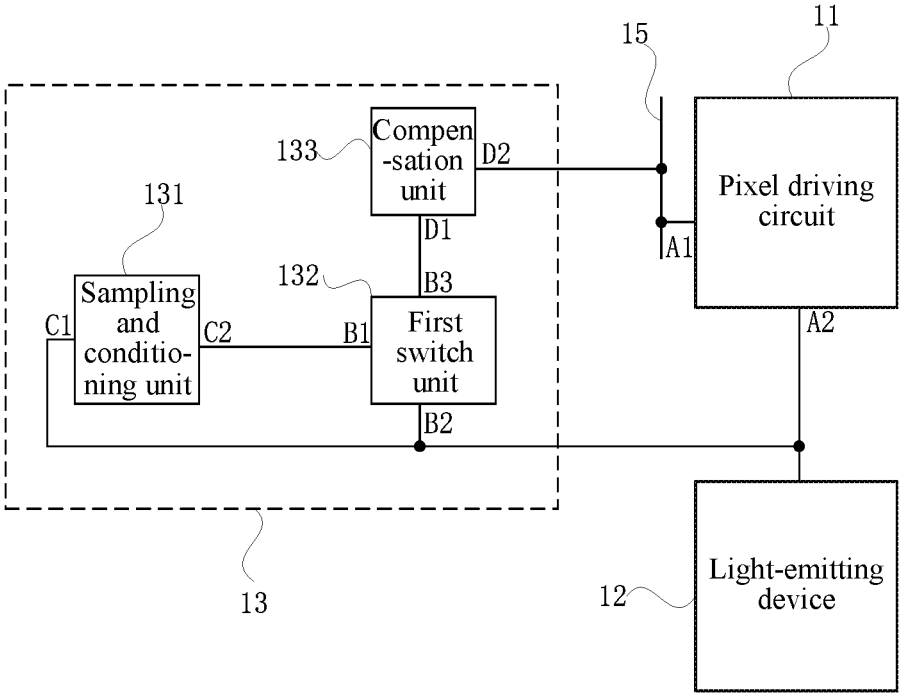
FIG. 1 is a structural diagram of a circuit of a display panel according to an embodiment of the present application.

The present application will be described hereinafter in conjunction with drawings and embodiments. The embodiments described herein are merely intended to explain and not to limit the present application. To facilitate description, only parts not all of the structures related to the present application are illustrated in the drawings.

FIG. 1 is a structural diagram of a circuit of a display panel according to an embodiment of the present application. Referring to FIG. 1, the display panel includes a data line 15, a pixel driving circuit 11, a light-emitting device 12 and a voltage compensation circuit 13.

The pixel driving circuit 11 includes a data signal input terminal A1 and an output terminal A2, where the data signal input terminal A1 of the pixel driving circuit 11 is electrically connected to the data line 15, and the output terminal A2 of the pixel driving circuit 11 is electrically connected to the light-emitting device 12.

The voltage compensation circuit 13 includes a sampling and conditioning unit 131, a first switch unit 132 and a compensation unit 133. The sampling and conditioning unit 131, which may also be referred to as a sampling and conditioning circuit 131, is configured to obtain a driving current output by the pixel driving circuit 11 and to output a control signal from an output terminal C2 of the sampling and conditioning unit 131 according to the driving current. The first switch unit 132, which may also be referred to as a first switch unit 132, includes a control terminal B1, an input terminal B2 and an output terminal B3, where the control terminal B1 of the first switch unit 132 is electrically connected to the output terminal C2 of the sampling and conditioning unit 131, the input terminal B2 of the first switch unit 132 is electrically connected to the output terminal A2 of the pixel driving circuit 11, and the first switch unit 132 is configured to control turn-on or turn-off between the input terminal B2 of the first switch unit 132 and the output terminal B3 of the first switch unit 132 according to a control signal of the control terminal B1. The compensation unit 133, which may also be referred to as a compensation circuit 133, includes an input terminal D1 and an output terminal D2, where the input terminal D1 of the compensation unit 133 is electrically connected to the output terminal B3 of the first switch unit 132, the output terminal D2 of the compensation unit 133 is electrically connected to the data line 15, and the compensation unit 133 is configured to output a compensation voltage to the data line 15 under an action of a signal of the input terminal D1.

In the display process of the display panel, whether low temperature poly-silicon (LTPS) or oxide semiconductor formed in the process of manufacturing has the problem of poor uniformity or stability, and the brightness of organic light-emitting diode (OLED) itself is gradually reduced with the increase of the light-emitting time. Generally, the brightness of the OLED is directly proportional to a driving current, and the driving current is provided by a driving transistor in a pixel driving circuit and is related to the characteristic parameters of the driving transistor. The parameters influencing the magnitude of the current include the magnitude of the mobility and the threshold voltage of the driving transistor, the driving voltage of the OLED, the magnitude of power supply voltage and the like and will cause a display brightness difference. The difference is related to a previously displayed image and is often presented as an image-sticking phenomenon, which is commonly referred to as a residual image. Through the set of the voltage compensation circuit 13, the driving current at the output terminal A2 of the pixel driving circuit 11 is detected. When the brightness displayed in the next frame needs to be compensated for, the voltage compensation circuit 13 outputs the compensation voltage to the data line 15 of the pixel driving circuit 11 in the display process of the next frame of the pixel driving circuit 11, so that the influence on the driving current of the pixel driving circuit 11 caused by the magnitudes of the mobility and the threshold voltage of the driving transistor, the driving voltage of the OLED and the power supply voltage is eliminated, and the image-sticking phenomenon is eliminated. Exemplarily, the pixel driving circuit 11 may output the driving current corresponding to the magnitude of a data voltage according to the data voltage on the data line 15, and the output driving current drives the light-emitting device 12 to emit light. An input terminal C1 of the sampling and conditioning unit 131 is electrically connected to the output terminal A2 of the pixel driving circuit 11 so as to obtain the driving current output by the pixel driving circuit 11 and generate a control signal according to the driving current, for example, to condition the driving current to a control voltage, that is, to convert the driving current to the control voltage. When the control voltage satisfies a condition that a compensation is required, for example, the control voltage exceeds a set threshold, the first switch unit 132 is controlled to turn on the input terminal B2 and the output terminal B3 of the first switch unit 132, so that the driving current at the output terminal A2 of the pixel driving circuit 11 is output to the compensation unit 133, and the compensation unit 133 outputs the compensation voltage to the data line 15 of the pixel driving circuit 11 according to the driving current at the output terminal A2 of the pixel driving circuit 11 to compensate the voltage on the data line and thus eliminate the image-sticking phenomenon.

In the embodiment, a display panel including a pixel driving circuit, a light-emitting device, a sampling and conditioning unit, a first switch unit and a compensation unit is adopted, a driving current of the pixel driving circuit in a current frame is sampled, the sampled driving current is conditioned by the sampling and conditioning unit to generate a control signal, and an input terminal of the compensation unit and an output terminal of the pixel driving circuit are turned on by the first switch unit according to the control signal, a compensation voltage is generated by the compensation unit to a data line according to the driving current of the pixel driving circuit, so that an image-sticking phenomenon of a displayed picture is eliminated, and a better display effect is achieved. Meanwhile, the voltage compensation circuit of the embodiment may be an external compensation. In the embodiment, the external compensation refers to a method of sensing the electrical or optical characteristics of a pixel through an external driving circuit or equipment and then performing compensation. Generally, the pixel structure and driving mode of an internal compensation mode are more complex, the compensation effect is limited to the threshold voltage compensation and a voltage drop (IR drop) compensation of the driving transistor, the compensation range is smaller, so that the problem of the residual image is difficult to solve. For the compensation mode adopted by the display panel provided by the embodiment of the present application, the pixel circuit does not need to be changed, and the compensation mode has the advantages of a simple pixel structure, a high driving speed and a large compensation range.

Figure 2:
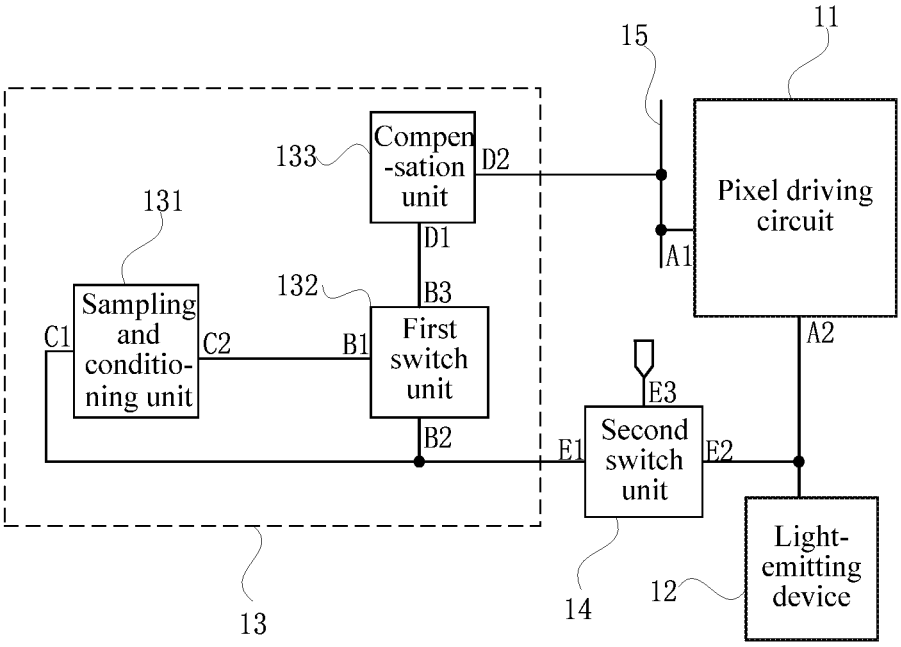
FIG. 2 is a structural diagram of a circuit of a display panel including a second switch unit based on the embodiment shown in FIG. 1.

In an embodiment, FIG. 2 is a structural diagram of a circuit of a display panel including a second switch unit based on the embodiment shown in FIG. 1. Referring to FIG. 2, the display panel further includes a second switch unit 14, which may also be referred to as a second switch circuit 14. A first terminal E1 of the second switch unit 14 is electrically connected to the input terminal C1 of the sampling and conditioning unit 131, a second terminal E2 of the second switch unit 14 is electrically connected to the output terminal A2 of the pixel driving circuit 11, and the second switch unit 14 is configured to control turn-on or turn-off the input terminal C1 of the sampling and conditioning unit 131 and the output terminal A2 of the pixel driving circuit 11 according to a control signal of a control terminal E3 of the second switch unit 14.

When the requirement for the display effect is lower, the control terminal E3 of the second switch unit 14 may be controlled to turn off the second switch unit 14, and the compensation unit 13 does not collect the current from the output terminal A2 of the pixel driving circuit 11, so that the load of the processor in the display panel is reduced, and the energy consumption is reduced. When the requirement for the display effect is higher, the control terminal E3 of the second switch unit 14 is controlled to turn on the second switch unit 14, so that when the driving current of the pixel driving circuit 11 satisfies a condition that the next frame of the picture needs to be compensated for, the compensation unit 133 generates a compensation signal to compensate the data signal on the data line 15, thereby eliminating the image-sticking phenomenon. Through the set of the second switch unit 14, the flexibility of the compensation is improved, and the energy consumption of the display panel can be reduced while the display requirement is satisfied.

Figure 3:
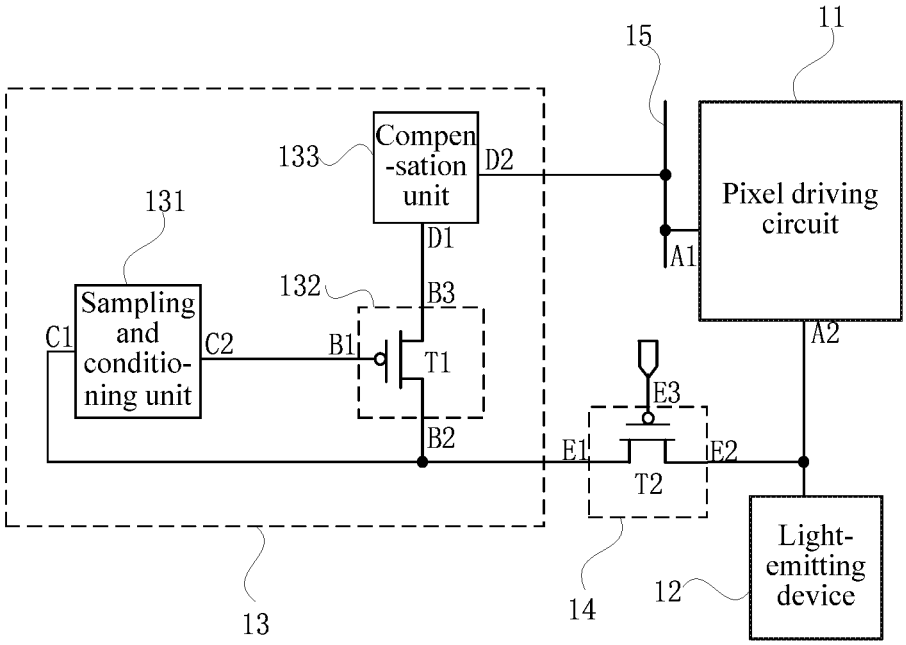
FIG. 3 is a structural diagram of a circuit of a display panel including a first transistor and a second transistor based on the embodiment shown in FIG. 2.

In an embodiment, FIG. 3 is a structural diagram of a circuit of a display panel including a first transistor and a second transistor based on the embodiment shown in FIG. 2. Referring to FIG. 3, the first switch unit 132 includes a first transistor T1, the second switch unit 14 includes a second transistor T2, a gate of the first transistor T1 is electrically connected to the control terminal B1 of the first switch unit 132, a first electrode of the first transistor T1 is electrically connected to the input terminal B2 of the first switch unit 132, and a second electrode of the first transistor T1 is electrically connected to the output terminal B3 of the first switch unit 132. A gate of the second transistor T2 is electrically connected to the control terminal E3 of the second switch unit 14, a first electrode of the second transistor T2 is electrically connected to the first terminal E1 of the second switch unit 14, and a second electrode of the second transistor T2 is electrically connected to the second terminal E2 of the second switch unit 14.

In an embodiment, the first transistor T1 and the second transistor T2 both serve as switches, the first transistor T1 and the second transistor T2 may both adopt a positive channel metal oxide semiconductor (PMOS) transistor, and when a low-level voltage is applied to the gate of the PMOS transistor, a first electrode and a second electrode of the PMOS transistor are turned on. The PMOS transistor has the advantages of being low in cost, easy to be integrated on a display panel and the like. That the first transistor T1 and the second transistor T2 adopt the PMOS transistor is beneficial to reduce the overall cost of the display panel. Of course, the first transistor T1 or the second transistor T2 may also adopt a negative channel metal oxide semiconductor (NMOS) transistor.

Figure 4:
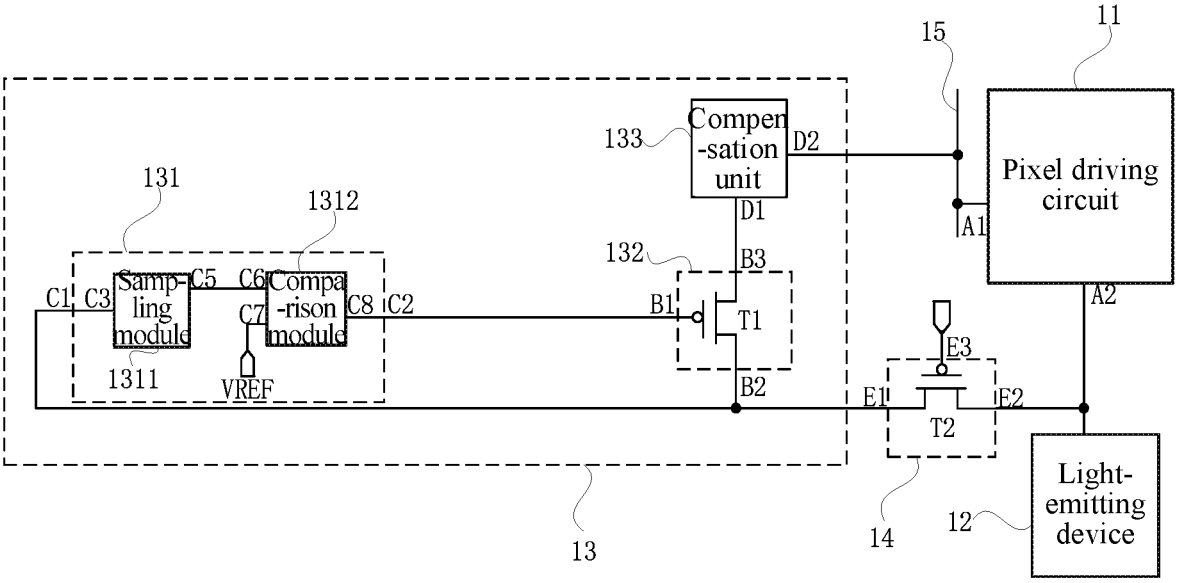
FIG. 4 is a structural diagram of a circuit of a display panel including a comparison module based on the embodiment shown in FIG. 3.

In an embodiment, FIG. 4 is a structural diagram of a circuit of a display panel including a comparison module based on the embodiment shown in FIG. 3. Referring to FIG. 4, the sampling and conditioning unit 131 includes a sampling module 1311 and a comparison module 1312. An input terminal C3 of the sampling module 1311 is electrically connected to the input terminal C1 of the sampling and conditioning module 131, and the sampling module 1311 is configured to obtain the driving current output by the pixel driving circuit 11 and to output a voltage corresponding to the driving current to the comparison module 1312. A first input terminal C6 of the comparison module 1312 is electrically connected to an output terminal C5 of the sampling module 1311, a second input terminal C7 of the comparison module 1312 is configured to receive a reference signal VREF, and an output terminal C8 of the comparison module 1312 is electrically connected to the control terminal B1 of the first switch unit 132.

In an embodiment, the sampling module 1311 collects the driving current from the output terminal A2 of the pixel driving circuit 11, converts the driving current into a voltage and outputs the voltage to the first input terminal C6 of the comparison module 1312. When the input voltage at the first input terminal C6 of the comparison module 1312 is higher than the reference signal VREF, that is, when a condition that the compensation is required is satisfied, the comparison module 131 outputs a control signal to turn on the first transistor T1, so that the input terminal D1 of the compensation unit 133 and the output terminal A2 of the pixel driving circuit 11 are turned on, and the compensation unit 133 generates a compensation voltage according to the driving current of the pixel driving circuit 11 to compensate the data voltage on the data line 15, thereby eliminating the image-sticking phenomenon. Illustratively, the reference signal VREF may be provided by a driving chip in the display panel, thereby a separate chip does not need to be set to generate the reference signal, and the cost of the display panel is reduced.

Figure 5:
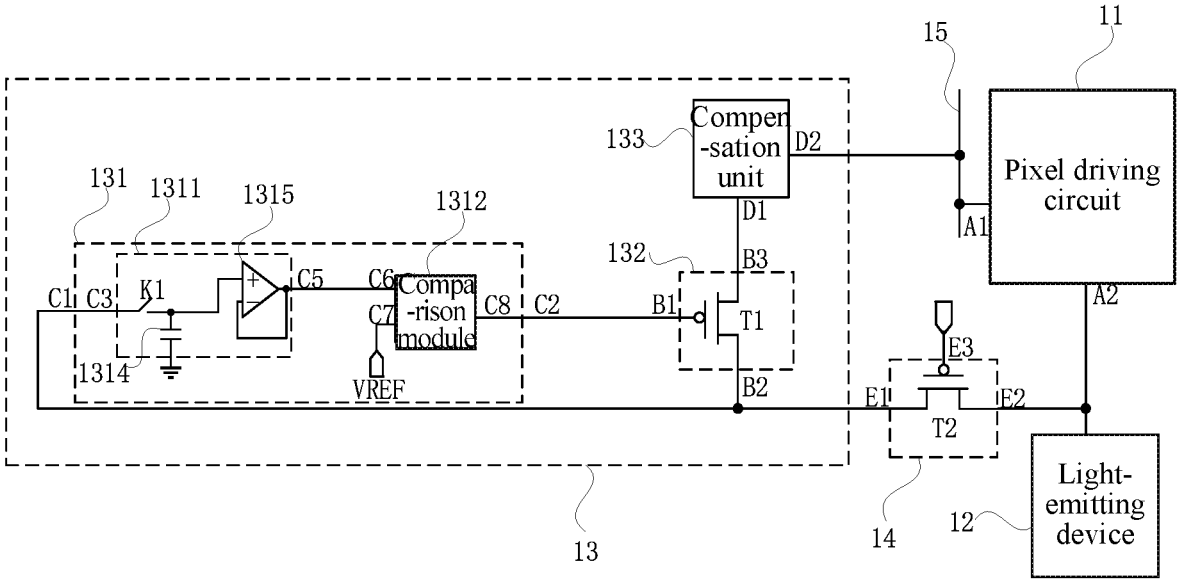
FIG. 5 is a structural diagram of a circuit of a display panel including a first analog switch based on the embodiment shown in FIG. 4.

In an embodiment, FIG. 5 is a structural diagram of a circuit of a display panel including a first analog switch based on the embodiment shown in FIG. 4. Referring to FIG. 5, the sampling module 1311 includes a first analog switch K1, a first capacitor 1314 and an operational amplifier 1315. The first analog switch K1 includes a first terminal and a second terminal, and the first terminal of the first analog switch K1 is electrically connected to the input terminal C3 of the sampling module 1311. A first terminal of the first capacitor 1314 is electrically connected to the second terminal of the first analog switch K1, and a second terminal of the first capacitor 1314 is grounded. A first input terminal of the operational amplifier 1315 is electrically connected to the second terminal of the first analog switch K1, a second input terminal of the operational amplifier 1315 is electrically connected to an output terminal of the operational amplifier 1315, and the output terminal of the operational amplifier 1315 is electrically connected to the output terminal C5 of the sampling module 131.

In an embodiment, the first analog switch K1 and the first capacitor 1314 form a sample and hold circuit. When the driving current of the pixel driving circuit 11 needs to be collected, the first analog switch K1 is closed firstly to charge the first capacitor 1314, and then the first analog switch K1 is opened in a holding process, so that the first capacitor 1314 keeps a constant voltage in a certain time and provide a stable voltage signal for the comparison module 1312 to generate a control signal. The operational amplifier 1315 forms a power supply following circuit, the first input terminal of the operational amplifier 1315 may be a non-inverting input terminal, the second input terminal of the operational amplifier 1315 may be an inverting input terminal. Thus, the output voltage of the first capacitor 1314 can be buffered, and the driving capability can be improved, so that the signal output by the sampling module 1311 can be facilitated to be input to the comparison module 1312 for matching.

Figure 6:
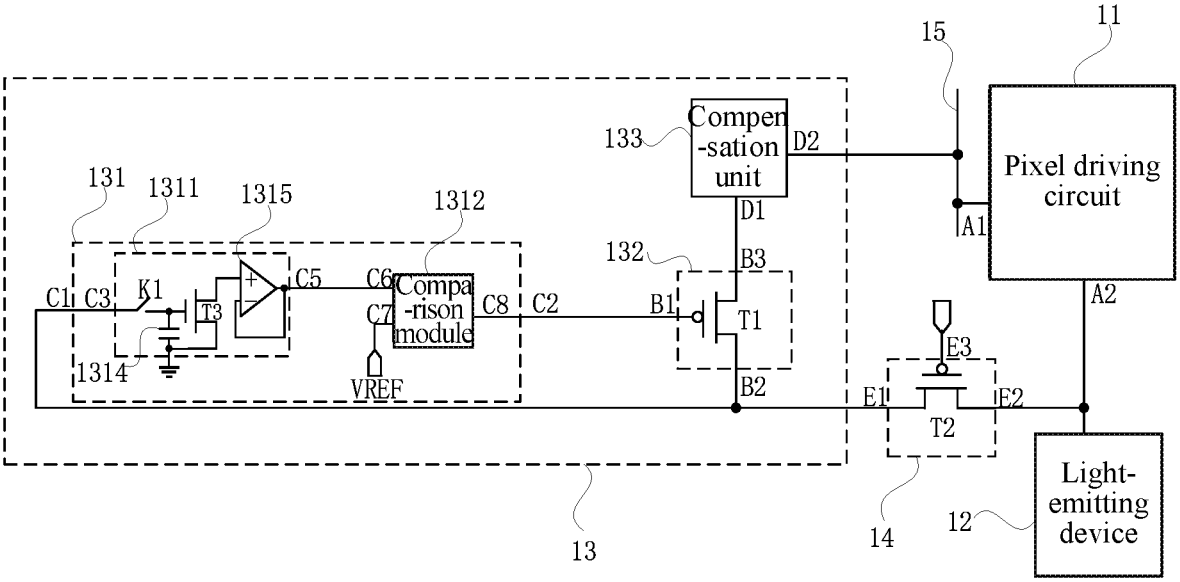
FIG. 6 is a structural diagram of a circuit of a display panel including a third transistor based on the embodiment shown in FIG. 5.

In an embodiment, FIG. 6 is a structural diagram of a circuit of a display panel including a third transistor based on the embodiment shown in FIG. 5. The sampling module 1311 further includes a third transistor T3. A gate of the third transistor T3 is electrically connected to the second terminal of the first analog switch K1, a first electrode of the third transistor T3 is electrically connected to the first input terminal of the operational amplifier 1315, and a second electrode of the third transistor T3 is grounded.

Exemplarily, the third transistor T3 adopts an NMOS transistor. The voltage signal output by an output terminal of the first capacitor 1314 may be smaller, and the output voltage of the first capacitor 1314 may be amplified through the third transistor T3 so that the voltage signal output by the sampling module 1311 satisfies a condition for the voltage comparison performed by the comparison module 1312, thereby ensuring the accuracy of compensation to the data line 15 by the compensation circuit 13.

Figure 7:
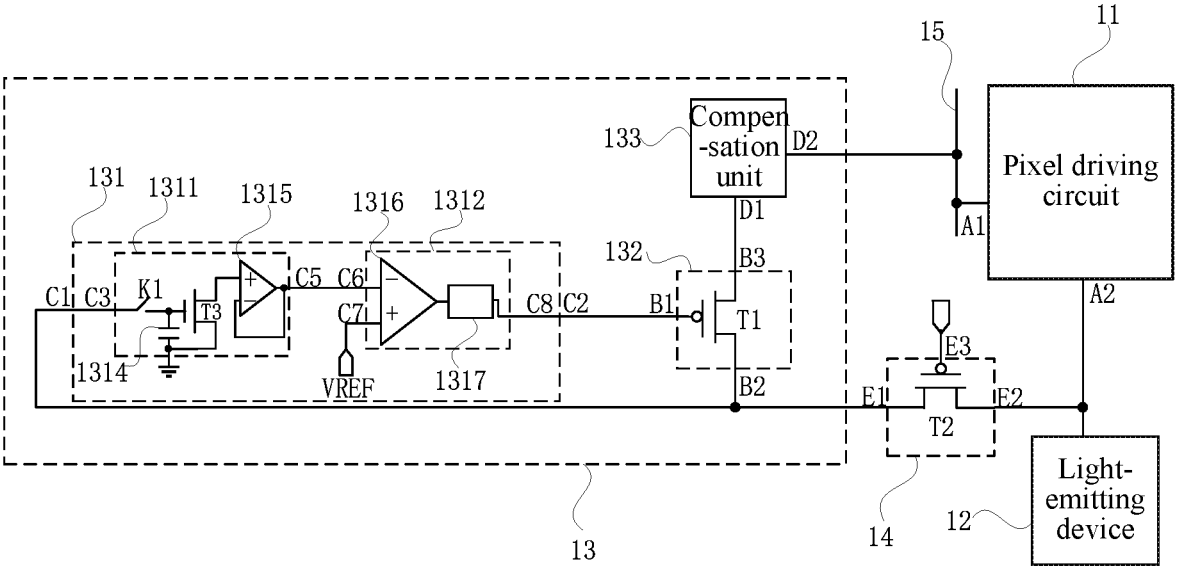
FIG. 7 is a structural diagram of a circuit of a display panel including a comparator based on the embodiment shown in FIG. 6.

In an embodiment, FIG. 7 is a structural diagram of a circuit of a display panel including a comparator based on the embodiment shown in FIG. 6. Referring to FIG. 7, the comparison module 1312 includes a comparator 1316 and a digital-to-analog converter 1317. A first input terminal of the comparator 1316 is electrically connected to the first input terminal C6 of the comparison module 1312, and a second input terminal of the comparator 1316 is electrically connected to the second input terminal C7 of the comparison module 1312. An input terminal of the digital-to-analog converter 1317 is electrically connected to an output terminal of the comparator 1316, an output terminal of the digital-to-analog converter 1317 serves as the output terminal C8 of the comparison module 1312, and the output terminal of the digital-to-analog converter 1317 and the output terminal C8 of the comparison module 1312 are a same port.

In an embodiment, the first input terminal C6 of the comparator 1316 may be an inverting input terminal, and the second input terminal C7 of the comparator 1316 may be a non-inverting input terminal. When the voltage signal input from the inverting input terminal of the comparator 1316 is higher than the voltage signal input from the non-inverting input terminal, the output terminal of the comparator 1316 outputs a low-level signal, that is, when the driving current output by the pixel driving circuit 11 is higher than a certain value, for example, the current displayed picture shows a high gray scale, the voltage on the first capacitor 1314, after being amplified and buffered by the third transistor T3 and the operational amplifier 1315, is higher than the voltage value of the reference signal VREF, at the moment, the comparator 1316 outputs a low-level signal, the digital-to-analog converter 1317 converts the low-level digital signal into an analog voltage signal so as to turn on the first transistor T1, and the compensation unit 133 can generate a compensation signal according to the driving current of the pixel driving circuit 11 and output the compensation signal to the data line 15 to compensate the next frame of picture, thereby eliminating the image-sticking phenomenon.

Figure 8:
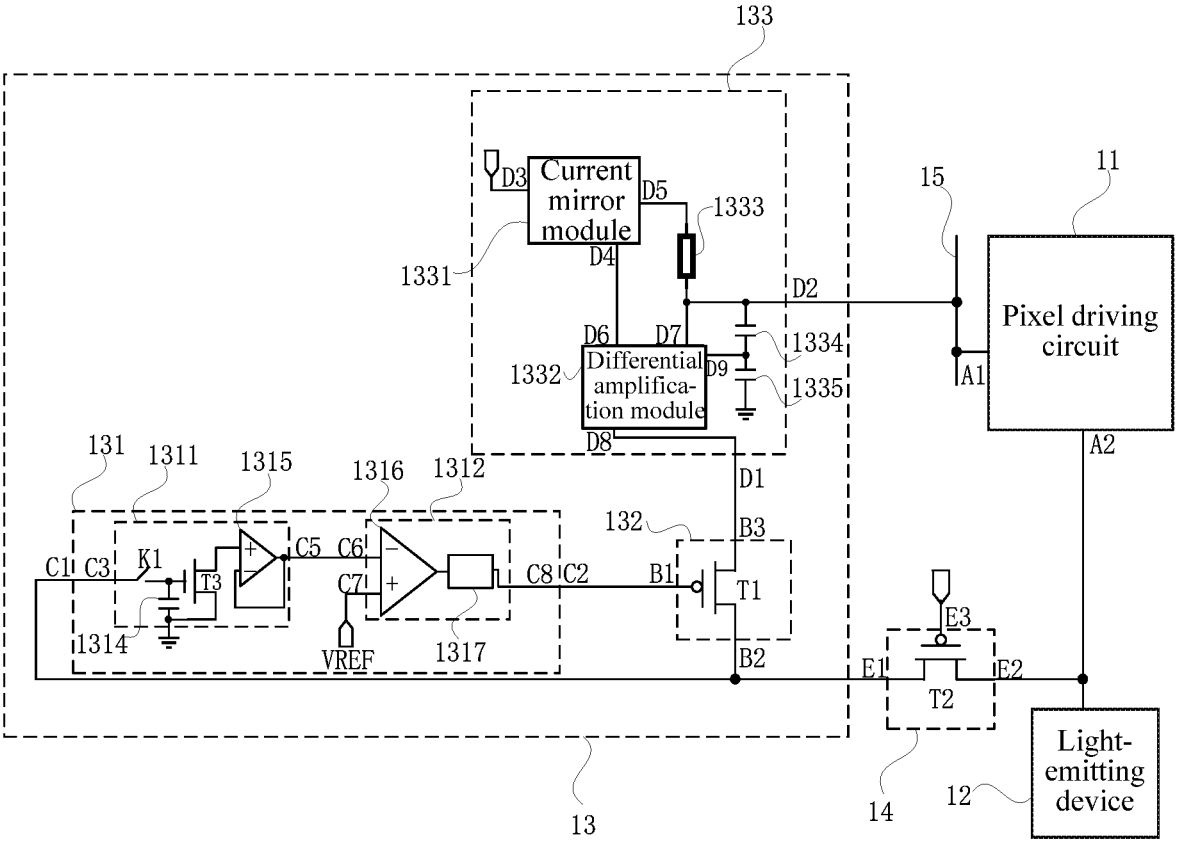
FIG. 8 is a structural diagram of a circuit of a display panel including a current mirror module based on the embodiment shown in FIG. 7.

In an embodiment, FIG. 8 is a structural diagram of a circuit of a display panel including a current mirror module based on the embodiment shown in FIG. 7. Referring to FIG. 8, the compensation unit 133 includes a current mirror module 1331, a first resistor 1333, a second capacitor 1334, a third capacitor 1335 and a differential amplification module 1332. A first input terminal D3 of the current mirror module 1331 is configured to receive a reference current, a second input terminal of the current mirror module 1331 is electrically connected to a first output terminal D6 of the differential amplification module 1332, and an output terminal D5 of the current mirror module 1331 is electrically connected to a first terminal of the first resistor 1333. A first terminal of the second capacitor 1334 is electrically connected to the output terminal D2 of the compensation unit 133, and a second terminal of the second capacitor 1334 is electrically connected to a second input terminal D9 of the differential amplification module 1332. A first input terminal D8 of the differential amplification module 1332 is electrically connected to the input terminal D1 of the compensation unit 133, and a second output terminal D7 of the differential amplification module 1332 is electrically connected to a second terminal of the first resistor 1333. A first terminal of the third capacitor 1335 is electrically connected to the second terminal of the second capacitor 1334, and a second terminal of the third capacitor 1335 is grounded. The second terminal of the first resistor 1333 is electrically connected to the output terminal D2 of the compensation unit 133.

When the first transistor T1 and the second transistor T2 are both turned on, that is, when the pixel driving circuit 11 needs to be compensated, the driving current at the output terminal A2 of the pixel driving circuit 11 is converted by the first capacitor 1314 into a voltage signal and loaded at the first input terminal D8 of the differential amplification module 1332, the data voltage on the data line 15 is loaded through a voltage division effect of the second capacitor 1334 and the third capacitor 1335 at the second input terminal D9 of the differential amplification module 1332 to provide an initial voltage signal for the differential amplification module 1332. The differential amplification module 1332 generates an output current at the first output terminal D6 of the differential amplification module 1332 according to the input voltage signal at the first input terminal D8 and inputs the output current to the second input terminal D4 of the current mirror module 1331, an input current at the first input terminal D3 of the current mirror module 1331 and the input current at the second input terminal D4 cooperate to generate a compensation current at the output terminal D5 of the current mirror module 1332, the compensation current is converted into a compensation voltage through the first resistor 1333 so as to be output to the data line 15, so that the compensation for the display effect of the light-emitting device 12 is completed, and the image-sticking phenomenon is eliminated. When the gray scales displayed are different, that is, the currents output by the output terminal A2 of the pixel driving circuit 11 are different, the output voltages of the first capacitors 1334 are different, thus the input voltages at the first input terminal D8 of the differential amplification module 1332 are different, the output currents generated by the first output terminal D6 of the differential amplification module 1332 are different, and the currents output by the current mirror module 1331 are also different under the action of the current mirror module 1331. Finally, the voltage signals loaded on the data lines 15 are different, and thereby a compensation effect matched with the displayed gray scale for different displayed gray scales is achieved.

Figure 9:
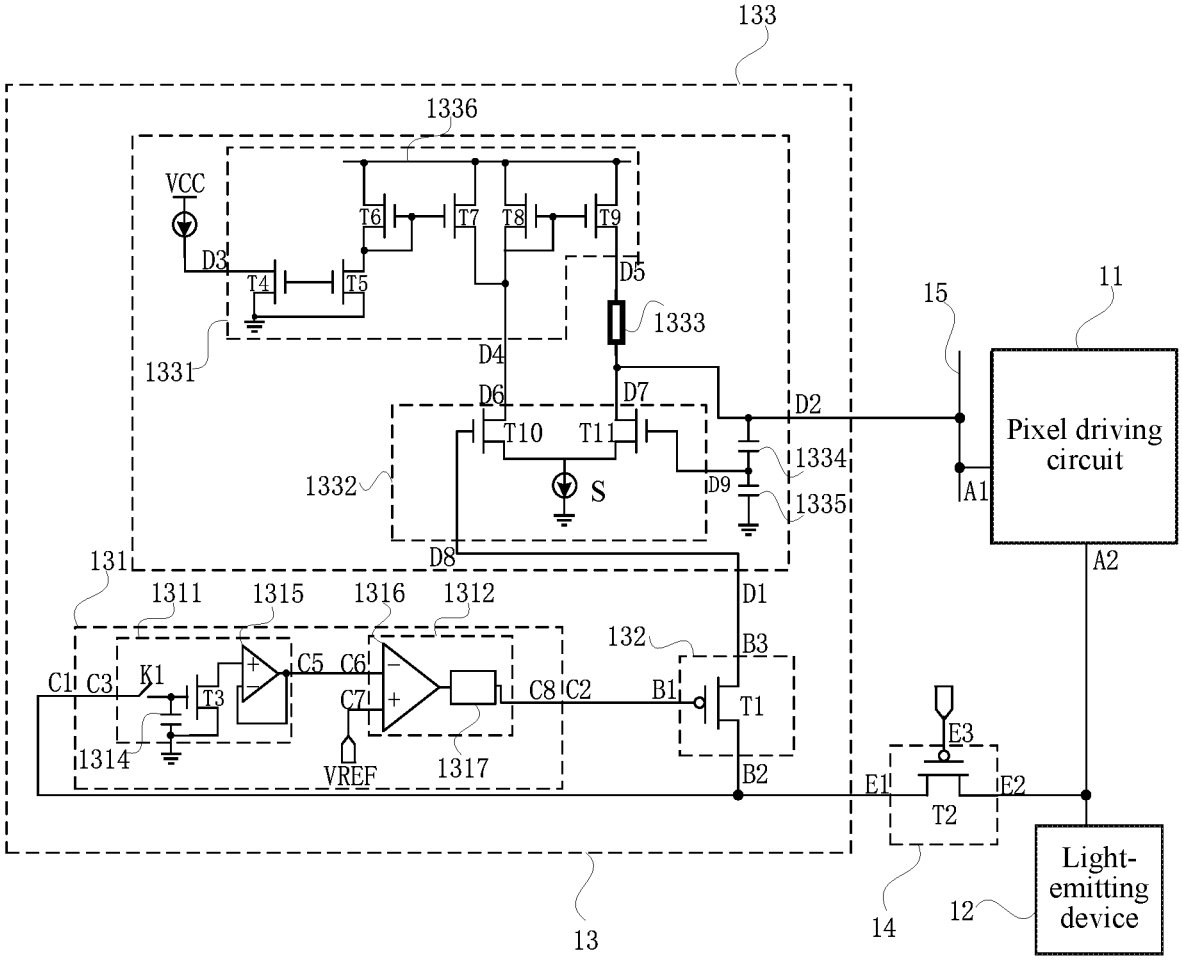
FIG. 9 is a structural diagram of a circuit of a display panel including a fourth transistor based on the embodiment shown in FIG. 8.

In an embodiment, FIG. 9 is a structural diagram of a circuit of a display panel including a fourth transistor based on the embodiment shown in FIG. 8. Referring to FIG. 9, the current mirror module 1331 includes a fourth transistor T4, a fifth transistor T5, a sixth transistor T6, a seventh transistor T7, an eighth transistor T8 and a ninth transistor T9. A first electrode of the fourth transistor T4 is electrically connected to the first input terminal D3 of the current mirror module 1331 and is configured to be electrically connected to a first current source, as shown in FIG. 9, a first terminal of the first current source may be connected to a first power supply VCC, a second terminal is electrically connected to the first electrode of the fourth transistor T4, and a second electrode of the fourth transistor is grounded. A gate of the fifth transistor T5 is electrically connected to a gate of the fourth transistor T4, and a first electrode of the fifth transistor T5 is grounded. A first electrode of the sixth transistor T6 is electrically connected to a second electrode of the fifth transistor T5, a gate of the sixth transistor T6 is electrically connected to the first electrode of the sixth transistor T6, and a second electrode of the sixth transistor T6 is configured to be electrically connected to a power supply, for example to a power line 1336. A first electrode of the seventh transistor T7 is configured to be electrically connected to the power line 1336, a gate of the seventh transistor T7 is electrically connected to the gate of the sixth transistor T6, and a second electrode of the seventh transistor T7 is electrically connected to a second electrode of the eighth transistor T8. A first electrode of the eighth transistor T8 is configured to be electrically connected to the power line 1336, a gate of the eighth transistor T8 is electrically connected to the second electrode of the eighth transistor T8, and the second electrode of the eighth transistor T8 is electrically connected to the second input terminal D4 of the current mirror module 1331. A first electrode of the ninth transistor T9 is configured to be electrically connected to the power line 1336, a gate of the ninth transistor T9 is electrically connected to the gate of the eighth transistor T8, and a second electrode of the ninth transistor T9 is electrically connected to the output terminal D5 of the current mirror module 1331.

The differential amplification module 1332 includes a tenth transistor T10 and an eleventh transistor T11. A first electrode of the tenth transistor T10 is electrically connected to the first output terminal D6 of the differential amplification module 1332, a gate of the tenth transistor T10 is electrically connected to the first input terminal D8 of the differential amplification module 1332, and a second electrode of the tenth transistor T10 is configured to be electrically connected to a second current source S. A first electrode of the eleventh transistor T11 is electrically connected to the second output terminal D7 of the differential amplification module 1332, a second electrode of the eleventh transistor T11 is configured to be electrically connected to the second current source S, and a gate of the eleventh transistor T11 is electrically connected to the second input terminal D9 of the differential amplification module 1332.

The tenth transistor T10 and the eleventh transistor T11 form a differential pair, on the one hand, an offset voltage can be eliminated, on the other hand, different output currents can be generated for different displayed gray scales, so that different compensation currents are generated under the action of the current mirror module 1331. The fourth transistor T4 and the fifth transistor T5 form a current mirror, the sixth transistor T6 and the seventh transistor T7 form the current mirror, and the eighth transistor T8 and the ninth transistor T9 form the current mirror. The specific operation principle of the current mirror is known to those skilled in the art and will not be described in detail herein.

Figure 10:
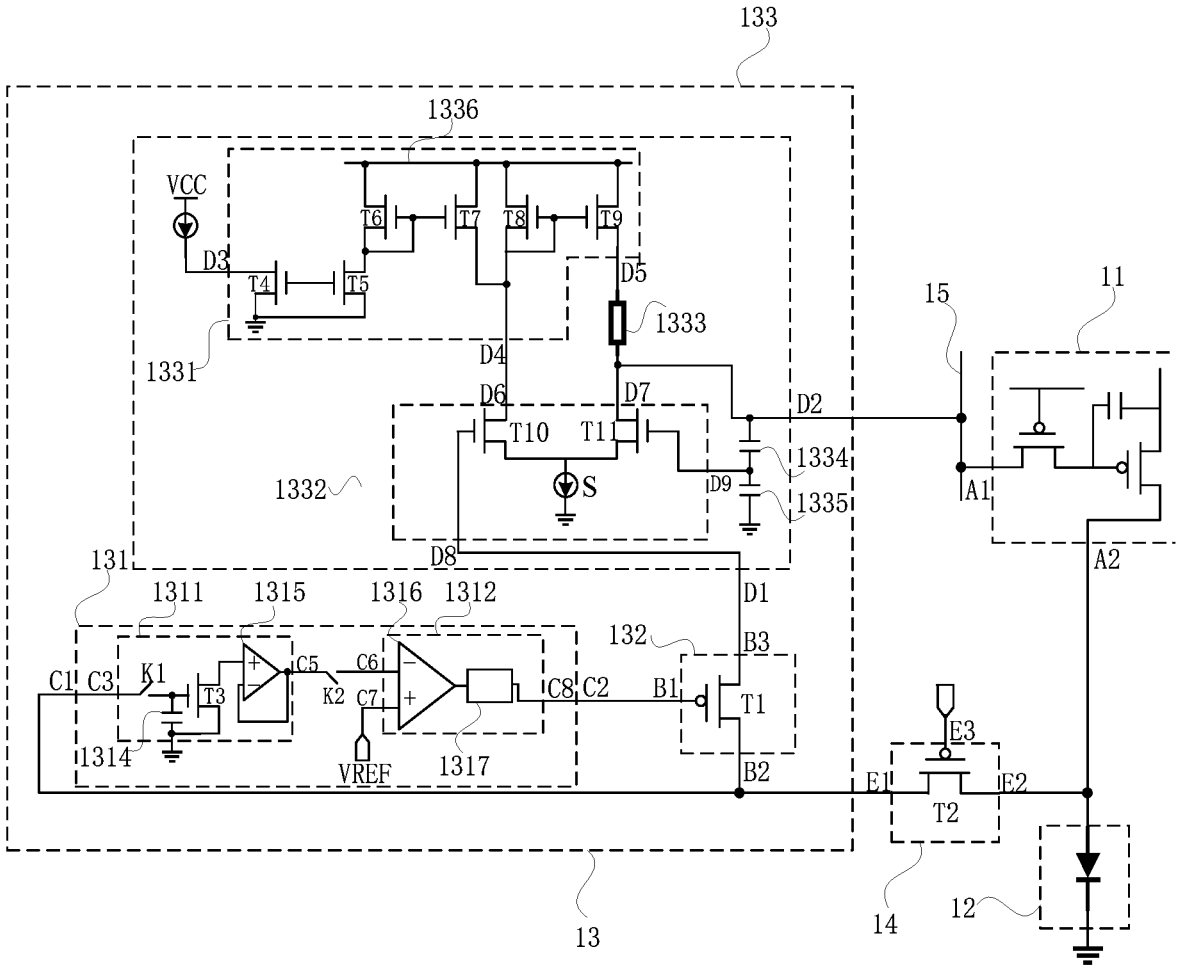
FIG. 10 is a structural diagram of a circuit of a display panel including a second analog switch based on the embodiment shown in FIG. 9.

In an embodiment, FIG. 10 is a structural diagram of a circuit of a display panel including a second analog switch based on the embodiment shown in FIG. 9. Referring to FIG. 10, the display panel may include a second analog switch K2. A first terminal of the second analog switch K2 is electrically connected to the output terminal C5 of the sampling module 1311, and a second terminal of the second analog switch K2 is electrically connected to the first input terminal C6 of the comparison module 1312. The second analog switch K2 may be configured to control the time during which the comparison module 1312 performs a signal comparison, so that an analog signal input to the first input terminal C6 of the comparison module 1312 remains substantially unchanged during the comparison time. The pixel driving circuit 11 in FIG. 10 adopts a 2T1C circuit, that is, the pixel driving circuit is configured to include two transistors and one capacitor, and the corresponding light-emitting device 12 adopts an OLED. In other implementations of the embodiments of the present application, the pixel driving circuit 11 may adopt any type of driving circuit and is not limited by the embodiments of the present application.

Figure 11:
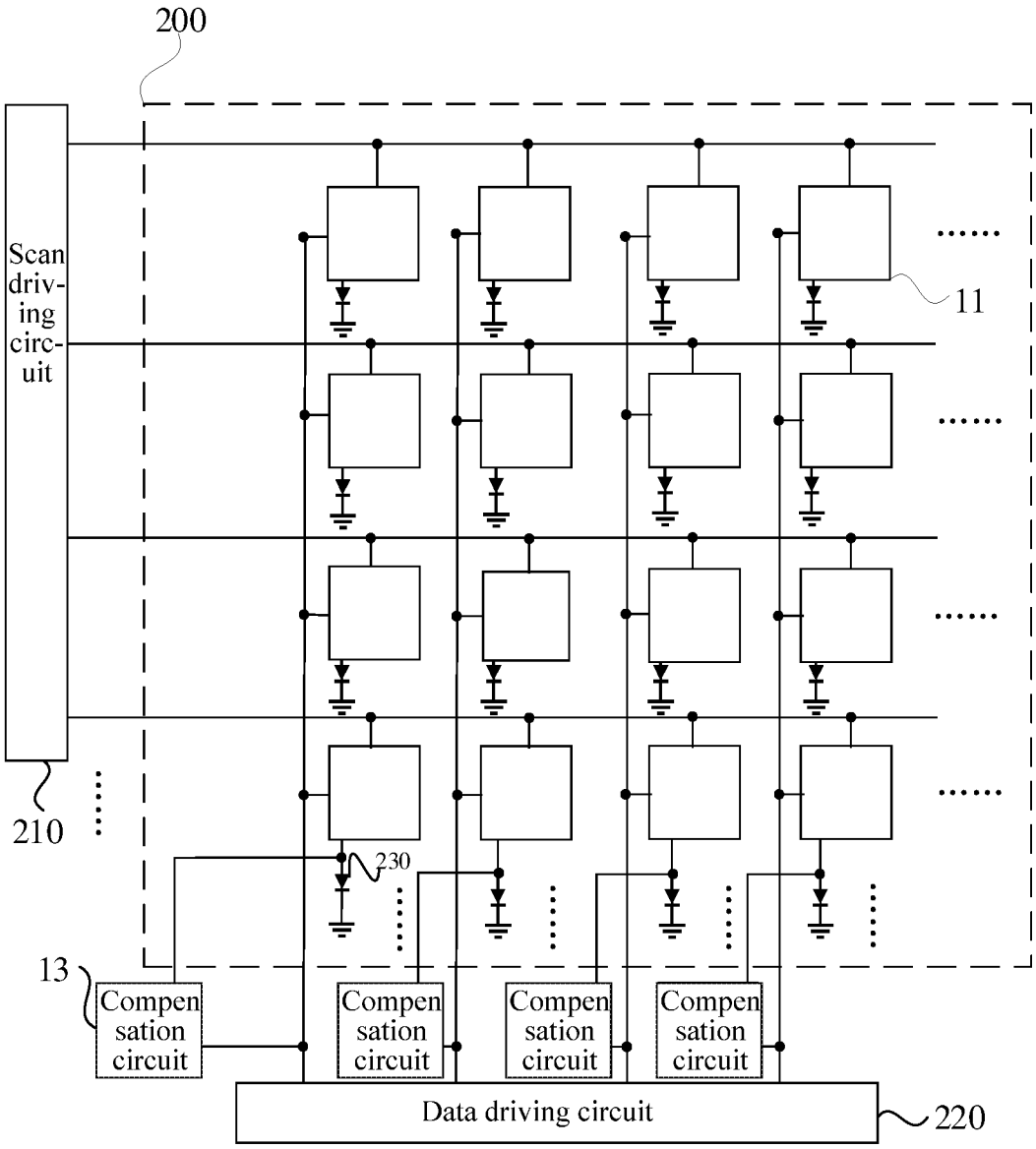
FIG. 11 is a structural diagram of a circuit of a display panel including a plurality of pixel driving circuits based on the embodiment shown in FIG. 10.

FIG. 11 is a structural diagram of a circuit of a display panel including a plurality of pixel driving circuits based on the embodiment shown in FIG. 10. Referring to FIG. 11, the display panel includes a display region 200, where the display region 200 includes a plurality of pixel driving circuits 11 disposed in arrays and a plurality of OLEDs 230 corresponding to the plurality of pixel driving circuits 11. Illustratively, as the structure shown in FIG. 11, pixel driving circuits in a same column 11 may share one compensation circuit 13, that is, the output terminals of the pixel driving circuits 11 in a same column are connected to a same compensation circuit 13, so that the complexity of the circuit design can be reduced, and the compensation circuit 13, the scan driving circuit 210 and the data driving circuit 220 are all located in a non-display region of the display panel, thus the display panel can have a higher aperture ratio.

Figure 12:
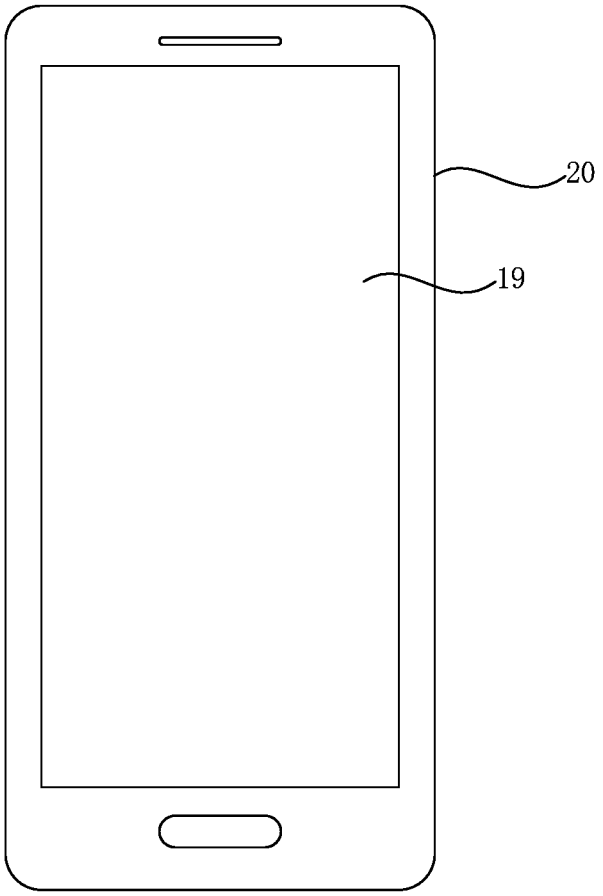
FIG. 12 is a structural diagram of a display apparatus according to an embodiment of the present application.

FIG. 12 is a structural diagram of a display apparatus according to an embodiment of the present application. Referring to FIG. 12, the display apparatus may include any one of the display panels provided by the embodiments of the present application and may perform the function of any one of the display panels provided by the embodiments of the present application. The structure and function of the specific display panel may be understood with reference to the description of the display panel of the embodiments of the present application.

What is claimed is:

1. A display panel, comprising a data line, a pixel driving circuit, a light-emitting device and a voltage compensation circuit; wherein the pixel driving circuit comprises a data signal input terminal and an output terminal, the data signal input terminal of the pixel driving circuit being electrically connected to the data line, and the output terminal of the pixel driving circuit being electrically connected to the light-emitting device; and the voltage compensation circuit comprises:

a sampling and conditioning unit configured to obtain a driving current output by the pixel driving circuit and to output a control signal from an output terminal of the sampling and conditioning unit according to the driving current;

a first switch unit, comprising a control terminal, an input terminal and an output terminal; the control terminal of the first switch unit being electrically connected to the output terminal of the sampling and conditioning unit, and the input terminal of the first switch unit being electrically connected to the output terminal of the pixel driving circuit; and the first switch unit being configured to control turn-on or turn-off between the input terminal of the first switch unit and the output terminal of the first switch unit according to a signal of the control terminal of the first switch unit; and a compensation unit, comprising an input terminal and an output terminal, the input terminal of the compensation unit being electrically connected to the output terminal of the first switch unit, the output terminal of the compensation unit being electrically connected to the data line, and the compensation unit being configured to output a compensation voltage to the data line under an action of a signal of the input terminal of the compensation unit, wherein the compensation unit comprises: a current mirror module, a first resistor, a second capacitor, a third capacitor and a differential amplification module;

a first input terminal of the current mirror module being configured to receive a reference current, a second input terminal of the current mirror module being electrically connected to a first output terminal of the differential amplification module, and an output terminal of the current mirror module being electrically connected to a first terminal of the first resistor;

a first terminal of the second capacitor being electrically connected to the output terminal of the compensation unit, and a second terminal of the second capacitor being electrically connected to a second input terminal of the differential amplification module;

a first input terminal of the differential amplification module being electrically connected to the input terminal of the compensation unit, and a second output terminal of the differential amplification module being electrically connected to a second terminal of the first resistor;

a first terminal of the third capacitor being electrically connected to the second terminal of the second capacitor, and a second terminal of the third capacitor being grounded; and the second terminal of the first resistor being electrically connected to the output terminal of the compensation unit.

2. The display panel according to claim 1, further comprising:

a second switch unit, wherein a first terminal of the second switch unit is electrically connected to an input terminal of the sampling and conditioning unit, a second terminal of the second switch unit is electrically connected to the output terminal of the pixel driving circuit, and the second switch unit being configured to control turn-on or turn-off between the input terminal of the sampling and conditioning unit and the output terminal of the pixel driving circuit according to a control signal of a control terminal of the second switch unit.

3. The display panel according to claim 2, wherein the first switch unit comprises a first transistor, a gate of the first transistor being electrically connected to the control terminal of the first switch unit, a first electrode of the first transistor being electrically connected to the input terminal of the first switch unit, and a second electrode of the first transistor being electrically connected to the output terminal of the first switch unit.

4. The display panel according to claim 3, wherein the second switch unit comprises a second transistor, a gate of the second transistor being electrically connected to the control terminal of the second switch unit, a first electrode of the second transistor being electrically connected to the first terminal of the second switch unit, and a second electrode of the second transistor being electrically connected to the second terminal of the second switch unit.

5. The display panel according to claim 4, wherein the sampling and conditioning unit comprises: a sampling module and a comparison module;

the sampling module is configured to obtain the driving current output by the pixel driving circuit and to output a voltage corresponding to the driving current to the comparison module; and a first input terminal of the comparison module is electrically connected to an output terminal of the sampling module, a second input terminal of the comparison module is configured to receive a reference signal, and an output terminal of the comparison module is electrically connected to the control terminal of the first switch unit.

6. The display panel according to claim 2, wherein the sampling and conditioning unit comprises: a sampling module and a comparison module;

the sampling module is configured to obtain the driving current output by the pixel driving circuit and to output a voltage corresponding to the driving current to the comparison module; and a first input terminal of the comparison module is electrically connected to an output terminal of the sampling module, a second input terminal of the comparison module is configured to receive a reference signal, and an output terminal of the comparison module is electrically connected to the control terminal of the first switch unit.

7. The display panel according to claim 1, wherein the sampling and conditioning unit comprises: a sampling module and a comparison module;

the sampling module is configured to obtain the driving current output by the pixel driving circuit and to output a voltage corresponding to the driving current to the comparison module; and a first input terminal of the comparison module is electrically connected to an output terminal of the sampling module, a second input terminal of the comparison module is configured to receive a reference signal, and an output terminal of the comparison module is electrically connected to the control terminal of the first switch unit.

8. The display panel according to claim 7, wherein the sampling module comprises:

a first analog switch, comprising a first terminal and a second terminal, the first terminal of the first analog switch being electrically connected to the input terminal of the sampling module;

a first capacitor, a first terminal of the first capacitor being electrically connected to the second terminal of the first analog switch, and a second terminal of the first capacitor being grounded; and an operational amplifier, a first input terminal of the operational amplifier being electrically connected to the second terminal of the first analog switch, a second input terminal of the operational amplifier being electrically connected to an output terminal of the operational amplifier, and an output terminal of the operational amplifier being electrically connected to the output terminal of the sampling module.

9. The display panel according to claim 8, wherein the sampling module further comprises a third transistor, a gate of the third transistor being electrically connected to the second terminal of the first analog switch, a first electrode of the third transistor being electrically connected to the first input terminal of the operational amplifier, and a second electrode of the third transistor being grounded.

10. The display panel according to claim 7, wherein the comparison module comprises:

a comparator, a first input terminal of the comparator being electrically connected to the first input terminal of the comparison module, and a second input terminal of the comparator being electrically connected to the second input terminal of the comparison module; and a digital-to-analog converter, an input terminal of the digital-to-analog converter being electrically connected to an output terminal of the comparator, and an output terminal of the digital-to-analog converter being electrically connected to the output terminal of the comparison module.

11. The display panel according to claim 1, wherein the current mirror module comprises:

a fourth transistor, a first electrode of the fourth transistor being electrically connected to the first input terminal of the current mirror module and being configured to be electrically connected to a first current source, and a second electrode of the fourth transistor being grounded;

a fifth transistor, a gate of the fifth transistor being electrically connected to a gate of the fourth transistor, and a first electrode of the fifth transistor being grounded;

a sixth transistor, a first electrode of the sixth transistor being electrically connected to a second electrode of the fifth transistor, a gate of the sixth transistor being electrically connected to the first electrode of the sixth transistor, and a second electrode of the sixth transistor being configured to be electrically connected to a power supply;

a seventh transistor, a first electrode of the seventh transistor being configured to be electrically connected to the power supply, a gate of the seventh transistor being electrically connected to the gate of the sixth transistor, and a second electrode of the seventh transistor being electrically connected to a second electrode of an eighth transistor;

the eighth transistor, a first electrode of the eighth transistor being configured to be electrically connected to the power supply, a gate of the eighth transistor being electrically connected to the second electrode of the eighth transistor, and the second electrode of the eighth transistor being electrically connected to the second input terminal of the current mirror module; and a ninth transistor, a first electrode of the ninth transistor being configured to be electrically connected to the power supply, a gate of the ninth transistor being electrically connected to the gate of the eighth transistor, and a second electrode of the ninth transistor being electrically connected to the output terminal of the current mirror module.

12. The display panel according to claim 11, wherein the differential amplification module comprises:

a tenth transistor, a first electrode of the tenth transistor being electrically connected to the first output terminal of the differential amplification module, a gate of the tenth transistor being electrically connected to the first input terminal of the differential amplification module, and a second electrode of the tenth transistor being configured to be electrically connected to a second current source; and an eleventh transistor, a first electrode of the eleventh transistor being electrically connected to the second output terminal of the differential amplification module, a second electrode of the eleventh transistor being configured to be electrically connected to the second current source, and a gate of the eleventh transistor being electrically connected to the second input terminal of the differential amplification module.

13. A display apparatus, comprising a display panel which comprises a data line, a pixel driving circuit, a light-emitting device and a voltage compensation circuit; wherein the pixel driving circuit comprises a data signal input terminal and an output terminal, the data signal input terminal of the pixel driving circuit being electrically connected to the data line, and the output terminal of the pixel driving circuit being electrically connected to the light-emitting device; and the voltage compensation circuit comprises:

a sampling and conditioning unit configured to obtain a driving current output by the pixel driving circuit and to output a control signal from an output terminal of the sampling and conditioning unit according to the driving current;

a first switch unit, comprising a control terminal, an input terminal and an output terminal; the control terminal of the first switch unit being electrically connected to the output terminal of the sampling and conditioning unit, and the input terminal of the first switch unit being electrically connected to the output terminal of the pixel driving circuit; and the first switch unit being configured to control turn-on or turn-off between the input terminal of the first switch unit and the output terminal of the first switch unit according to a signal of the control terminal of the first switch unit; and a compensation unit, comprising an input terminal and an output terminal, the input terminal of the compensation unit being electrically connected to the output terminal of the first switch unit, the output terminal of the compensation unit being electrically connected to the data line, and the compensation unit being configured to output a compensation voltage to the data line under an action of a signal of the input terminal of the compensation unit, wherein the compensation unit comprises: a current mirror module, a first resistor, a second capacitor, a third capacitor and a differential amplification module;

a first input terminal of the current mirror module being configured to receive a reference current, a second input terminal of the current mirror module being electrically connected to a first output terminal of the differential amplification module, and an output terminal of the current mirror module being electrically connected to a first terminal of the first resistor;

a first terminal of the second capacitor being electrically connected to the output terminal of the compensation unit, and a second terminal of the second capacitor being electrically connected to a second input terminal of the differential amplification module;

a first input terminal of the differential amplification module being electrically connected to the input terminal of the compensation unit, and a second output terminal of the differential amplification module being electrically connected to a second terminal of the first resistor;

a first terminal of the third capacitor being electrically connected to the second terminal of the second capacitor, and a second terminal of the third capacitor being grounded; and the second terminal of the first resistor being electrically connected to the output terminal of the compensation unit.

* * * * *